United States Patent [19]

Bengtsson et al.

[11] Patent Number: 4,900,399

[45] Date of Patent: Feb. 13, 1990

[54] METHOD OF MANUFACTURING BLEACHED CHEMI-MECHANICAL AND SEMICHEMICAL FIBRE PULP BY A TWO-STAGE IMPREGNATION PROCESS

[75] Inventors: Goran Bengtsson, Liljegangen 5, S-44005 Nodinge; Rune Simonson, Sotenasvagen 64, S-43364 Partille; Roland Agnemo, Ornskoldsvik, all of Sweden

[73] Assignees: Eka AB, Surte; Goran Bengtsson, Nodinge; Rune Simonson, Partille, all of Sweden

[21] Appl. No.: 196,796

[22] Filed: May 16, 1988

Related U.S. Application Data

[63] Continuation of Ser. No. 839,024, Mar. 12, 1986, abandoned.

[30] Foreign Application Priority Data

Mar. 13, 1985 [SE] Sweden ..... 8501247

[51] Int. Cl.[4] ..... D21B 1/02

[52] U.S. Cl. ..... 162/26; 162/19; 162/78

[58] Field of Search ..... 162/17, 19, 25, 90; 662/26, 78

[56] References Cited

U.S. PATENT DOCUMENTS 4,187,141 2/1980 Ahrel ..... 162/26

FOREIGN PATENT DOCUMENTS 7947182 8/1982 Australia .
0138484 4/1985 European Pat. Off. .
3109260 4/1982 Fed. Rep. of Germany .

OTHER PUBLICATIONS

Rydholm, *Puling Processes* (1965), pp. 417, 885 and 892.

*Primary Examiner*—Peter Chin
*Attorney, Agent, or Firm*—Young & Thompson

[57] ABSTRACT

Chemimechanical pulp is produced from lignocellulosic material in a process in which the material is impregnated in two stages. The material is treated in the first stage with alkaline and, subsequent to passing an intermediate draining and reaction step, in the second stage with a solution that contains peroxide. The quantities of alkali and peroxide charged are fully optional and are independent of one another. The material is then optionally subjected to a further drainage and reaction step, and thereafter pre-heated at a temperature of between 50° C. and 100° C., whereafter the material is refined in one or two stages.

The optimal brightness of the processed pulp for a given peroxide consumption is achieved by a balanced division of the peroxide charge between chip impregnation and bleaching.

12 Claims, 1 Drawing Sheet

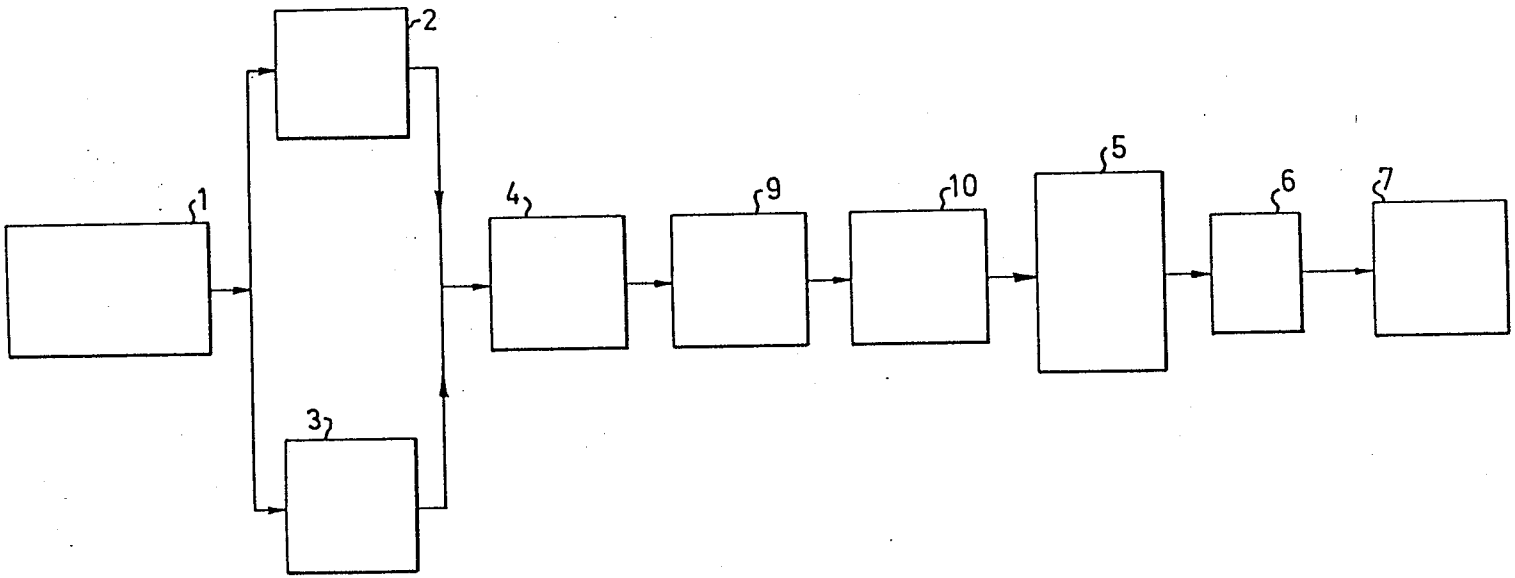
1
2
3
4
9
10
5
6
7

METHOD OF MANUFACTURING BLEACHED CHEMI-MECHANICAL AND SEMICHEMICAL FIBRE PULP BY A TWO-STAGE IMPREGNATION PROCESS

This is a continuation of application Ser. No. 839,024, filed Mar. 12, 1986, now abandoned.

The shortage of wood suitable for manufacturing pulp is becoming more and more acute, and in the future the use of short-fibre pulp for paper manufacturing purposes will increase as a result of the decreasing availability of conventional, long-fibre raw materials. The energy costs incurred in the manufacture of pulp are also rapidly increasing. Thus, the problem is two-fold and encompasses the need for improve methods which will facilitate a wider use of suitable varieties of wood within the industry, and which will satisfy the need for more economical and more effective refining and bleaching methods.

The object of the present invention is to solve and/or alleviate these problems prevailing in the pulp and paper industries. This object is achieved by a novel method of pre-treating wood chips.

Initially, wood pulp was produced by pressing a log against a rotating grindstone or pulpstone, to provide a finely divided fibre pulp. Due to the fact that the resultant pulp contained all the lignin present in the log, the yield obtained with such methods was in excess of 95%. The pulp also has a high shive content and low strength values, owing to the fact that grinding greatly reduces the lengths of the fibres.

In order to raise the quality of wood pulp, the so-called chemical methods, sulphite, sulphate, and soda, were developed. These methods involve chipping the wood and treating the wood chips with chemicals at elevated temperatures and pressures. The lignin and also part of the carbohydrates present are released in the enusing digestion process, and the pulp yield is normally about 45–50%. The pulps are then bleached in various sequences with chlorine, alkali, oxygen-gas, chlorine dioxide, hydrogen peroxide or hypochlorite, in order to remove residual lignin and other coloured impurities.

The chemical pulps have extremely good strength properties and high brightness value. These attributes, however, are obtained at the cost of low yields and the highly negative effect produced on the environment by the effluent from the bleaching department.

This has led in recent years to intensive development work aimed at producing mechanical pulps in high yields, ≦90%, and high brightness values, and with strength properties approaching those of the chemical pulps, while at the same time retaining the opacity and bulk properties unique to the mechanical pulps.

This development work has progressed in stages via Refiner Pulp (RMP), Thermomechanical Pulp (TMP), to the present variants of Chemimechanical Pulps (CMP, CTMP). Such pulps are used today in the manufacture of fluff, tissue and paperboard qualities.

The present invention relates to a novel, low-energy method of producing high yield chemimechanical pulp having a final brightness value not previously achieved, and a pulp which in addition to the traditional ranges of use can also be used to produce, for example, fine-paper qualities, due to the high brightness values attainable.

In accordance with the invention, the starting material used may be lignocellulosic fibre material which has been chopped or disintegrated into chips, debris or coarse fibre pulp, referred to hereinafter generally as chips. The chemical treatment of the chips, impregnation, is carried out in two stages with an aqueous solution of alkali and some kind of peroxides, respectively. Impregnation in the first stage is effected by immersing chips in impregnating solution or with apparatus of the screw-press type, such as a Sprout-Waldron plug screw feeder, or a Sunds-Defibrator "Prex". Other types of apparatus may be used, however. The second impregnating stage is carried out, to advantage, in apparatus of the screw-press type. An advantage is gained when the chips are treated with steam, steamed, prior to impregnation, although the result desired is not contingent on such steaming of the chips.

It has long been known that the alkali treatment of lignocellulosic fibre material softens the material as a result of chemical interaction. This softening of the material is beneficial, since the original geometric appearance of the fibres is retained during the refining process more readily than would otherwise be the case. Fibres can also be separated more completely from a softened material, thereby reducing the content of undesirable fibre material, such as shives.

During the process of softening the fibre material with alkali, some of the alkali charged to the process is consumed by the reaction with acid components in the wood, such as uronic acid groups and acetyl groups present in the hemicellulose.

It is known that treatment with alkali darkens the lignocellulosic material. The extent to which the material is darkened increases with increasing temperatures and alkali content, and is extremely troublesome at temperatures above 100° C. However, when the alkaline softener is combined with an organic or inorganic peroxide, this darkening of the material is counteracted while greatly improving, at the same time, the potential of the fibre material for increased brightness during a bleaching stage or a refining stage. The peroxide, in itself, also has a softening effect on the fibre material, and is thus also positive in this respect.

Hydrogen peroxide has its decomposition maximum at a pH of about 11.6. If the ratio between alkali and peroxide during the impregnation process is selected so that the pH approaches this value prior to, during, and immediately after the impregnation phase, the peroxide present will decompose while generating oxygen gas. Such reactions impair impregnation, due to the fact that the bubbles of gas generated in the voids present in the fibre material renders penetration of the impregnating solution difficult. This generation of gas can also result in impregnating liquid which has already entered the chips being expelled therefrom.

This can be avoided by first reacting the wood with alkali in a separate impregnating stage, such as to soften the wood to a major part of the total extent necessary and to neutralize the acid wood components, this procedure in the method according to the present invention corresponding to the first impregnation stage. By reacting the wood with alkali in a separate stage, in the aforesaid manner, it is possible to adapt the alkali charge and the temperature to values at which satisfactory softening of the wood is achieved, while at the same time minimizing losses in brightness. Much of the coloured reaction products obtained in the first impregnation stage are subsequently pressed from the material in the screw press following said first stage, which contributes in part to the good result obtained with respect to the brightness of the pulp after the refiner, and also with respect to the high potential for the further increase in brightness obtained by the pulp when tower bleached.

In addition, by balancing the amount of alkali charged to the first impregnation stage it is possible to determine at which pH the material shall enter the second impregnation stage and therewith provide optimal chip-bleaching conditions (pH 8–10) without risking the occurrence of the aforesaid negative reactions with respect to impregnation.

In the second impregnation stage, peroxide is introduced. By suitable selection of the charge, temperature, and residence time, it is possible to determine the brightness of the material leaving the refiner. This is made possible by the good bleaching properties of the peroxides. Part of the peroxide is consumed during and immediately after the second impregnation stage, therewith eliminating chromophore groups formed in conjunction with the alkali treatment. A large part of the peroxide remains in the material, however, and is effective in counter-acting the darkening effect of the relatively high temperatures prevailing during the subsequent beating process.

Impregnation can be effected either with or without the addition of complex builders, such as Diethylene Triamine Pentaacetic Acid, (DTPA), Ethylene Diamine Tetraacetic Acid, (EDTA), NTA, Dequest or the like in one or in both impregnation stages, and similarly also with or without the addition of any form of silica compound, for example water-glass solution. The admixture of siliceous material, however, can rapidly result in incrustation of the process apparatus, particularly on the structural components of the beating apparatus, where temperatures are high, and the use of such material is therefore preferably avoided.

Subsequent to being impregnated, the lignocellulosic material is permitted to react for periods of up to 60 minutes for each impregnation stage, preferably for periods between 5 and 30 minutes, at a temperature of between 20° and 100° C. Various reactions take place between the lignocellulosic material and the impregnating chemicals during this reaction period. These reactions lead to the softening of the material, which results in a higher pulp quality and a reduction in energy consumption during the subsequent beating process.

The invention will now be described in more detail with reference to an embodiment thereof and in conjunction with the accompanying drawing, the single FIGURE of which is a block schematic showing sequential impregnation. In this FIGURE, 1 indicates a steaming vessel, 2 is a tank for impregnation solution, 3 a screw press and 4 indicates a drainage stage. 9 is a screw press combined with an impregnation stage, 10 indicates a drainage stage, 5 a preheater to a refiner 6, and 7 indicates the prepared pulp.

EXAMPLE 1

Sequential Impregnation

Screened fresh chips produced from birch, Betula Verrucosa, were steamed in a steaming vessel 1 with water steam at atmospheric pressure (100°) for a period of 10 minutes, and were then immediately treated in a tank 2 with an impregnating solution comprising an aqueous solution of sodium hydroxide. At the moment of immersing the chips, the solution had a temperature of 20° C., the bath temperature preferably being maintained between 15° and 60° C. An impregnating period of 10 minutes was employed.

The chips were drained at 4 for 15 minutes at a temperature of 20° C., whereby the alkali obtained an extended reaction time. This reaction time can be varied between 5 and 60 minutes. Consumed impregnating solution is then pressed from the chips, by passing the chips to a screw press 3. The pulp sample I recited in Table 1 is an exception in this case, since this pulp sample was passed directly to the preheater, without being subjected to the intermediate compression step. The chips may also be impregnated by first draining the chips and compressing the same in the screw press 3 and then allowing the compressed chips to expand in the impregnating solution.

When analyzing the solution pressed from the chips, it was found that substantially all of the alkali charged to the impregnation stage had been consumed. Subsequent to pressing the chips, the chips were impregnated with peroxide in a screw press 9 and associated impregnating vessel, with extremely good absorption of liquid by the chips. Experiments were carried out with varying quantities of alkali and peroxide, and the results of these experiments have been set forth in the following Table 1. The pulp sample referenced 5 was treated with water, in order to provide a reference in the absence of peroxide.

Subsequent to draining the chips at 10 for 3 minutes at a temperature of 20° C., the chips were passed to the preheater 5 of the refiner and there pre-heated for 15 minutes at 80° C. In order to obtain any effect, it is essential that the pre-heating temperature exceeds 50° C., although it must not exceed 100° C. Subsequent to being pre-heated, the chips were beaten in an atmospheric double-disc refiner 6, "Sund-Bauer 36".

The weight ratio of impregnating liquid to wood was 7.5 to 1, with the weight of the wood being calculated on bone-dry chips. The alkali charge can be varied between 0.3 and 8% NaOH or corresponding amounts of other alkalies. Similarly, peroxide can be charged in amounts of up to 5% by weight hydrogen peroxide or corresponding amounts of other peroxides, persulphate or the like. Subsequent to being refined, the pulp had a dry solids content of 22% and a pH of 7.0–7.8.

The properties of the unbleached pulp (of Table I) with the exception of brightness, were determined immediately after refinement of the pulp, in accordance with SCAN methods after latency removal. The brightness of the pulp was measured on sheets produced on a sheet former and used for SCAN-testing of strength properties which gives a brightness value which is some units lower than that obtained when measuring in accordance with SCAN methods on sheets of high grammage produced on a Büchner funnel. Parts of the pulps were also bleached with hydrogen peroxide after latency removal.

The pulps were bleached on a laboratory scale with varying quantities of hydrogen peroxide and sodium hydroxide, water-glass and an organic complex builder, Diethylene Triamine Pentaacetic Acid (DTPA) in such proportions with respect to the amount of hydrogen peroxide charged as to obtain maximum brightness. The results are compiled in Table II. The laboratory bleaching processes were carried out at a temperature of 60° C., for two hours at a pulp concentration of 12%. The properties of the bleached pulp were also analyzed in accordance with SCAN methods, with the exception of brightness as in the foregoing.

TABLE I

| Sample No. | NaOH charged weight % on bone-dry chips | $H_2O_2$ charged weight % on bone-dry chips | Energy input kWh/ton CSF ~ 100 ml | Tensile index kNm/kg | Tear index $Nm^2/kg$ | Density $kg/m^3$ | Brightness % ISO | s $m^2/kg$ | k $m^2/kg$ |
|---|---|---|---|---|---|---|---|---|---|
| | | | Unbleached Pulp | | | | | | |
| 1 | 3,6 | — | 1080 | 26,0 | 3,2 | 340 | 38,0 | 40,4 | 20,6 |
| 2 | 3,8 | 0,7 | 1180 | 25,8 | 3,5 | 350 | 55,0 | 42,9 | 7,9 |
| 3 | 3,8 | 2,6 | 1050 | 31,5 | 4,2 | 400 | 59,7 | 42,2 | 2,2 |
| 4 | 2,6 | 3,2 | 1120 | 23,2 | 3,0 | 365 | 71,5 | 49,0 | 2,1 |
| 5 | 3,7 | 0 | 910 | 22,2 | 3,0 | 330 | 44,3 | 42,8 | 15,0 |

EXAMPLE 2

Pulps were produced from screened, fresh birch chips according to the invention and with substantially the same charge of alkali (NaOH) in the first impregnation step. In all cases, except for the reference sample, was added totally 5% of peroxide for chip impregnation and final pulp bleaching, but with varying distribution of peroxide between impregnation and final bleaching. The distribution of peroxide and pulp brightness after final bleaching is indicated in Table III.

TABLE III

| Sample | $H_2O_2$ charged weight % of a.t. chips in chip impregnation | $H_2O_2$ weight % of a.t. pulp in final bleaching | Final brightness % ISO |
|---|---|---|---|
| A (refe- | 0 | 5 | 74 |
| B rence) | 1.4 | 3.6 | 78 |
| C | 2.6 | 2.4 | 82 |
| D | 5 | 0 | 72 |

further increase in brightness when subjected to conventional bleaching with peroxide in a subsequent stage.

When, in accordance with the invention, peroxide is charged to the chips prior to defibrating or pulping the same but after treating the chips with alkali and pressing said chips to remove solution therefrom, it is possible to obtain, after the refiner, pulps having brightness values in excess of 70% ISO, in the absence of tower bleaching. When using present day techniques, it is not possible to produce mechanical pulps of such brightness without utilizing a bleach tower.

The system according to the invention enables this to be done with moderate peroxide charges and in the absence of siliceous stabilizors, which makes the process less expensive and also eliminates the problems of incrustation, a problem created by silicates in both the pulp and the paper industries.

By complementing the system according to the invention with conventional tower bleaching, it is possible either, by optimal division of a given amount of peroxide between the impregnation of chips and tower

TABLE II

| Sample No. | $H_2O_2$ charged weight % on bone-dry pulp | NaOH charged weight % on bone-dry pulp | Water-glass charged weight % on bone-dry pulp | DTPA charged weight % on bone-dry pulp | Tensile index kNm/kg | Tear index $Nm^2/kg$ | Density $kg/m^3$ | Brightness % ISO | s $m^2/kg$ | k $m^2/kg$ |
|---|---|---|---|---|---|---|---|---|---|---|
| | | | | Bleaching | | | | | | |
| 1:1 | 3 | 0,7 | 4 | 0,2 | 29,5 | 3,3 | 380 | 72,9 | 29,1 | 1,5 |
| 1:2 | 5 | 1,3 | 4 | 0,2 | 31,5 | 3,3 | 380 | 78,5 | 30,4 | 1,3 |
| 2:1 | 3 | 1,3 | 4 | 0,2 | 25,3 | 3,5 | 350 | 77,8 | 29,6 | 1,0 |
| 2:2 | 5 | 1,5 | 4 | 0,2 | 28,1 | 3,5 | 360 | 81,0 | 29,9 | 0,98 |
| 3:1 | 2 | 1,0 | 4 | 0,2 | 23,9 | 4,1 | 380 | 80,1 | 40,9 | 1,0 |
| 3:2 | 3 | 1,5 | 4 | 0,2 | 25,7 | 4,0 | 400 | 82,3 | 40,0 | 0,96 |
| 3:3 | 4 | 2,0 | 4 | 0,2 | 29,2 | 4,1 | 400 | 83,5 | 39,0 | 0,63 |
| 4:1 | 2 | 1,1 | 4 | 0,2 | 23,2 | 3,1 | 380 | 81,9 | 41,3 | 0,85 |
| 4:2 | 3 | 1,3 | 4 | 0,2 | 24,2 | 3,0 | 380 | 83,9 | 42,0 | 0,69 |
| 4:3 | 4 | 1,7 | 4 | 0,2 | 33,1 | 3,5 | 400 | 84,7 | 41,3 | 0,61 |
| 5:1 | 3 | 0,7 | 4 | 0,2 | 24,2 | 3,0 | 360 | 76,6 | 29,7 | 1,1 |
| 5:2 | 5 | 1,3 | 4 | 0,2 | 26,9 | 3,1 | 370 | 79,9 | 28,8 | 0.95 |

The results establish that if pulp produced in accordance with the invention is exposed to a subsequent conventional bleaching, then a maximum brightness for the bleached pulp can be obtained at a predetermined total peroxide charge, if the peroxide charge is optimally distributed between impregnation step (pretreatment of chip) and final bleaching step.

When, in accordance with the invention, peroxide is applied to the chips prior to defibrating and refining the same, two decisive advantages are obtained. The first of these resides in a reduction in the darkening of the material caused when treating the chips with alkali in the preceding impregnating stage, while the second resides in counter-action of the darkening effect of the high refining temperature to which the chips are exposed. Both these favourable factors also contribute towards improving substantially the potential of the pulp for a bleaching of pulp, to reduce the total amount of peroxide to a given brightness, or—which is preferably of greater interest—by charging moderate quantities of peroxide, optimally distributed, to obtain a finished pulp which has a brightness far in excess of that obtainable with the aid of present-day established techniques.

The system according to the invention is based on an advanced impregnating technique which enables the use of conventional factory-cut chips without requiring the chips to be reduced in size prior to being impregnated. Furthermore, a number of other advantages are obtained when pressing from the chips unreacted liquid and reaction products deriving from the first impregnating stage, in addition to the main advantage of enabling the peroxide-containing solution to penetrate into the chips.

These additional advantages reside in the partial removal from the chips of coloured impurities and oxygen-consuming substances which are otherwise liable to consume peroxide as it is supplied to the system, and in the removal of alkali from the chips, such that the pH of the chips is optional with respect to the bleaching reactions of the peroxide, while simultaneously eliminating the risk of inhomogeneous impregnation due to non-bleaching peroxide decomposition. Another valuable aspect of the system according to the invention is that the impregnating chemicals used, sodium hydroxide and peroxide, but optimally with respect to their respective purposes at temperatures beneath 100° C. Present day techniques are based on the use of chemicals whose optimal reaction temperature in this type of application lies considerably above 100° C.

When applying the invention, this difference in temperature enables energy input to be lowered during the impregnating phase and also imparts to the chips properties such that the energy requirement during the refining stage is also low, 600–1200 kWh/ton in a freeness range of 300–100 ml.

What we claim is:

1. In a method of manufacturing chemimechanical pulp with improved brightness and minimization of the peroxide consumption, comprising steaming, impregnation and refining chips of a lignocellulose material, the improvement comprising the further steps of:

impregnating said steamed chips with a aqueous alkali in the absence of added peroxide, in an amount balanced to give optimal pH in the following steps, removing excess unreacted said aqueous alkali from said chips, further impregnating said chips with a peroxide solution in the absence of added alkali in an amount sufficient for peroxide to be present during the refining step, the chips subsequent to said further impregnation having a pH of 7–11, preheating said chips at a temperature of 50°–100° C., and refining the chips to pulp in an atmospheric refiner.

2. Method according to claim 1, wherein said impregnating step comprises immersing said steamed chips in a bath of said aqueous alkali for a duration of not more than 20 minutes, at a temperature of 15°–60° C.

3. Method according to claim 1, wherein said aqueous alkali is a sodium hydroxide solution.

4. Method according to claim 1, wherein said impregnating step comprises allowing said steamed chips to expand in said aqueous alkali, subsequent to compression in a drainage screw press.

5. Method according to claim 1, wherein said removing step comprises treating said chips in a drainage screw press.

6. Method according to claim 1, wherein said removing step is preceded by a holding step with a duration of 5–60 minutes, whereby said chips and said aqueous alkali are able fully to react, said holding step being carried out in a vessel having a temperature maintained between 20° and 100° C.

7. Method according to claim 1, wherein said further impregnating step comprises allowing said chips to expand in said peroxide solution subsequent to compressing said chips in a drainage screw press.

8. Method according to claim 1, wherein said impregnating step comprises supplying said aqueous alkali to said chips in an amount corresponding to 0.3–8% by weight NaOH calculated on substantially dry said chips.

9. Method according to claim 1, wherein said further impregnating steps comprises supplying said peroxide solution to said chips in an amount corresponding to not more than 5% by weight $H_2O_2$ calculated on substantially dry said chips.

10. Method according to claim 1, and bleaching said pulp by supplying peroxide solution to said pulp.

11. Method according to claim 10, wherein a combined maximum of 10% $H_2O_2$ based on substantially dry chips is supplied to and distributed between said chips in said further impregnating step and said pulp in said bleaching step, thereby to impart maximum brightness to said bleached pulp.

12. Method according to claim 11, wherein at least 20% of the total combined amount of $H_2O_2$ is supplied to said chips in said further impregnating step and the remaining part of the total combined amount of $H_2O_2$ is supplied to said pulp in said bleaching step.

* * * * *